US006422495B1

(12) United States Patent
De Boef et al.

(10) Patent No.: US 6,422,495 B1
(45) Date of Patent: Jul. 23, 2002

(54) ROTARY GRINDER APPARATUS AND METHOD

(75) Inventors: Duane R. De Boef, New Sharon; Keith Roozeboom; Gary Verhoef, both of Pella, all of IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 09/513,011

(22) Filed: Feb. 25, 2000

(51) Int. Cl.[7] ..... B02C 13/28
(52) U.S. Cl. ..... 241/197; 241/294
(58) Field of Search ..... 241/294, 189.1, 241/191, 197, 194

(56) References Cited

U.S. PATENT DOCUMENTS

| | | | | |
|---|---|---|---|---|
| 20,282 A | | 5/1858 | Mackerley | |
| 380,245 A | | 3/1888 | Creager | |
| 750,329 A | | 1/1904 | Windingstad | |
| 939,776 A | | 11/1909 | Williams | |
| 939,777 A | | 11/1909 | Williams | |
| 1,344,832 A | | 6/1920 | Stubbs | |
| 1,565,842 A | * | 12/1925 | Aram | 241/294 |
| 2,221,002 A | | 11/1940 | Mankoff | |
| 3,380,672 A | | 4/1968 | Weispfenning | |
| 3,650,484 A | | 3/1972 | Kimble et al. | |
| 3,758,035 A | | 9/1973 | Ushiku et al. | |
| 4,056,232 A | | 11/1977 | Linnerz et al. | |
| 4,076,177 A | | 2/1978 | Hirayama et al. | |
| 4,114,817 A | | 9/1978 | Harris | |
| 5,967,436 A | | 10/1999 | Balvanz | |
| 6,042,035 A | | 3/2000 | Grobler et al. | |

FOREIGN PATENT DOCUMENTS

DE 3211648 A1 10/1983

OTHER PUBLICATIONS

Figure entitled "FIG. 1 (Prior Art)" from patent application Serial No. 09/513,011, 1 pg. (Feb. 25, 2000).

* cited by examiner

*Primary Examiner*—Mark Rosenbaum
(74) *Attorney, Agent, or Firm*—Merchant & Gould P.C.

(57) ABSTRACT

A rotary grinder having a cylindrical drum that includes a cylindrical surface. The cylindrical surface defines two holes. The drum receives opposite ends of a through-member at the two holes such that the opposite ends of the through-member comprise hammers when the cylindrical drum is rotated. A single retaining member is used to secure all of the through-members to the drum.

35 Claims, 13 Drawing Sheets

ROTARY GRINDER APPARATUS AND METHOD

FIELD OF THE INVENTION

The present invention relates generally to rotary grinders used for grinding things such as waste materials. More particularly, the present invention relates to rotary grinders having rotating arrangements of hammers.

BACKGROUND OF THE INVENTION

Tub grinders for grinding waste material such as trees, brush, stumps, pallets, railroad ties, peat moss, paper, wet organic materials and the like are well known. An example of such prior art tub grinders is shown in commonly assigned U.S. Pat. No. 5,507,441 dated Apr. 16, 1996. Another example is shown in U.S. Pat. No. 5,419,502 dated May 30, 1995.

Tub grinders typically include a rotary grinding device such as a hammermill that is mounted on a frame for rotation about a horizontal axis. A rotating tub surrounds the grinding device. The tub rotates about a generally vertical axis. Debris is deposited in the rotating tub and the grinding device grinds the debris.

FIG. 1 illustrates one type of prior art hammermill 20 commonly used with conventional tub grinders. The hammermill 20 includes a plurality of hammers 22 secured to a plurality of rotor plates 24. The rotor plates 24 are rotatably driven about a generally horizontal axis of rotation 26. Cutters 25 (e.g., cutter blocks, cutter teeth, etc.) are mounted on the hammers 22 (e.g., with nuts 30 and bolts 28). The hammers 22 are secured between the rotor plates 24 by shafts or rods 31 aligned generally parallel to the horizontal axis of rotation 26. For example, each hammer defines two holes 32 and 34 each positioned to receive a different shaft 31 (only one shown). Shims 36 are mounted between the hammers 22 and the rotor plates 24. When the rotor plates 24 are rotated about the axis of rotation 26, the hammers 22 are carried by the rotor plates 24 in a generally circular path. Material desired to be ground is fed into the circular path such that the material is impacted and reduced in size by the cutters 25 of the hammers 22.

A conventional tub grinder also typically includes a sizing screen (not shown) that curves along a lower half of the hammermill. A grinding chamber is formed between the screen and the hammermill. The screen performs a sizing function and defines a plurality of openings having a predetermined size. In use, material desired to be ground is repeatedly impacted by the hammers 22 against the screen causing the material to be reduced in size. When the material is reduced to a size smaller than the predetermined size of the openings defined by the screen, the material moves radially through the screen. Upon passing through the screen, the reduced material commonly falls by gravity to a discharge system located beneath the hammermill 20.

Hammer wear is a significant concern relating to hammermills. For example, hammer wear results in loss of hammer integrity, out-of-balance conditions, reductions in grinding efficiency, and increases in maintenance and service costs. With a conventional hammermill, it is difficult to replace the hammers because the hammermill must be disassembled. Disassembling a hammermill can be particularly labor intensive and time consuming because the rods used to connect the hammers to the hammermill are quite heavy. There are typically several rods per hammermill and frequently two rods must be removed to replace a single hammer. Furthermore, rods can be corroded in place or deformed thereby making it even more time consuming and costly to disassemble a hammermill.

SUMMARY OF THE INVENTION

One aspect of the present invention relates to a rotary grinder having a cylindrical drum rotatable about its axis. The cylindrical drum has a cylindrical wall, a first end and a second end. The cylindrical wall defines a first receiving hole and a second receiving hole for receiving opposite ends of a through-member. The first end of the through-member extends to the outside of the cylindrical wall by passing through the first receiving hole such that the first end of the through-member comprises a first grinding portion (e.g., a hammer, cutter, blade, tooth, etc.) when the cylindrical drum is rotated. Likewise, the second end of the through-member extends to the outside of the cylindrical wall by passing through the second receiving hole such that the second end of the through-member comprises a second grinding portion (e.g., a hammer, cutter, blade, tooth, etc.) when the cylindrical drum is rotated. Thus, the through-member forms a duplex grinding member (e.g., a duplex hammer).

Another aspect of the present invention relates to a grinding device having a plurality of grinding members secured to a drum by a single retaining member that extends longitudinally through the drum.

In accordance with another aspect of the invention, a method for replacing a drum in a rotary grinder is presented. The rotary grinder includes a rotatable drum having a first end and a second end and a cylindrical surface. The rotary grinder also includes a plurality of hammers attached to the cylindrical surface and a first end cap attached to the first end of the drum and a second end cap attached to the second end of the drum. The method comprises the steps of removing the first end cap from the rotatable drum; removing the second end cap from the rotatable drum; replacing the rotatable drum with a second rotatable drum; attaching the first end cap to the first end of the second rotatable drum; and attaching the second end cap to the second end of the second rotatable drum.

A variety of advantages of the invention will be set forth in part in the description that follows, and in part will be apparent from the description, or may be learned by practicing the invention. It is to be understood that both the foregoing general description and the following detailed description are explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows:

FIG. 2 1S a schematic illustration of a tub grinder incorporating aspects of the invention;

FIG. 8 shows another duplex hammer adapted for use with the hammermill of FIG. 5*a.

DETAILED DESCRIPTION

Reference will now be made in detail to exemplary aspects of the present invention which are illustrated in the accompanying drawings. Wherever possible, the same reference numbers will be used throughout the drawings to refer to the same or like parts.

Figure 1:
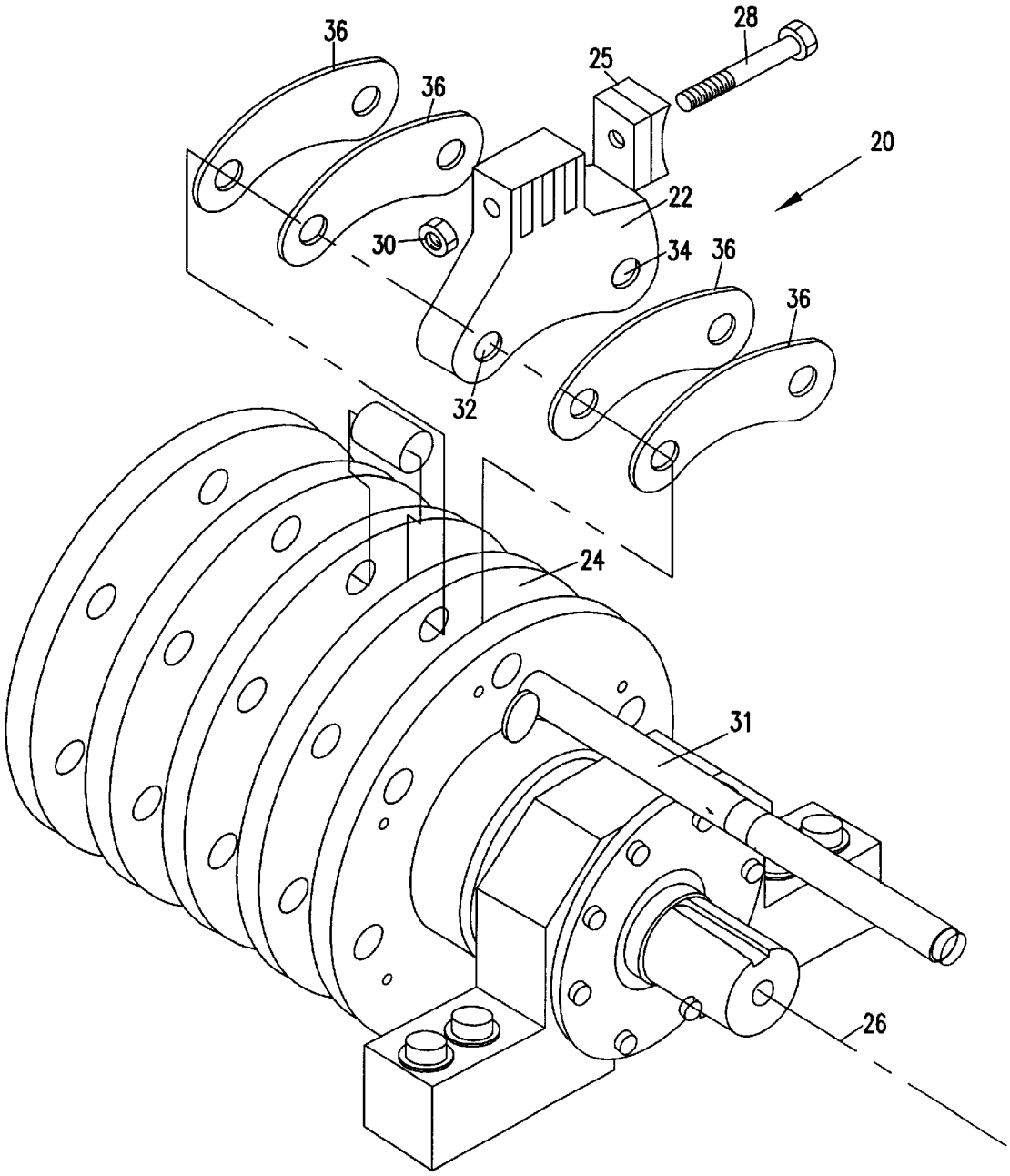
FIG. 1 (Prior Art)
FIG. 1 is a perspective view of a prior art hammermill assembly.
Figure 2:
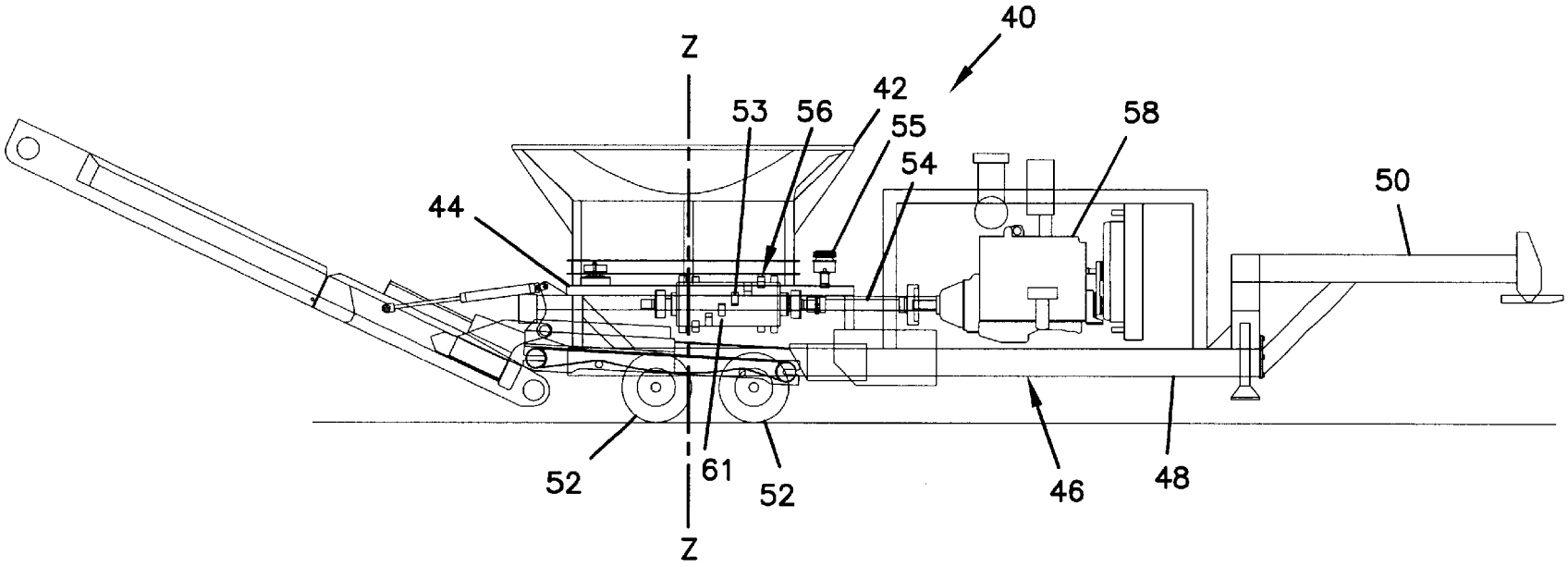
Figure 3:
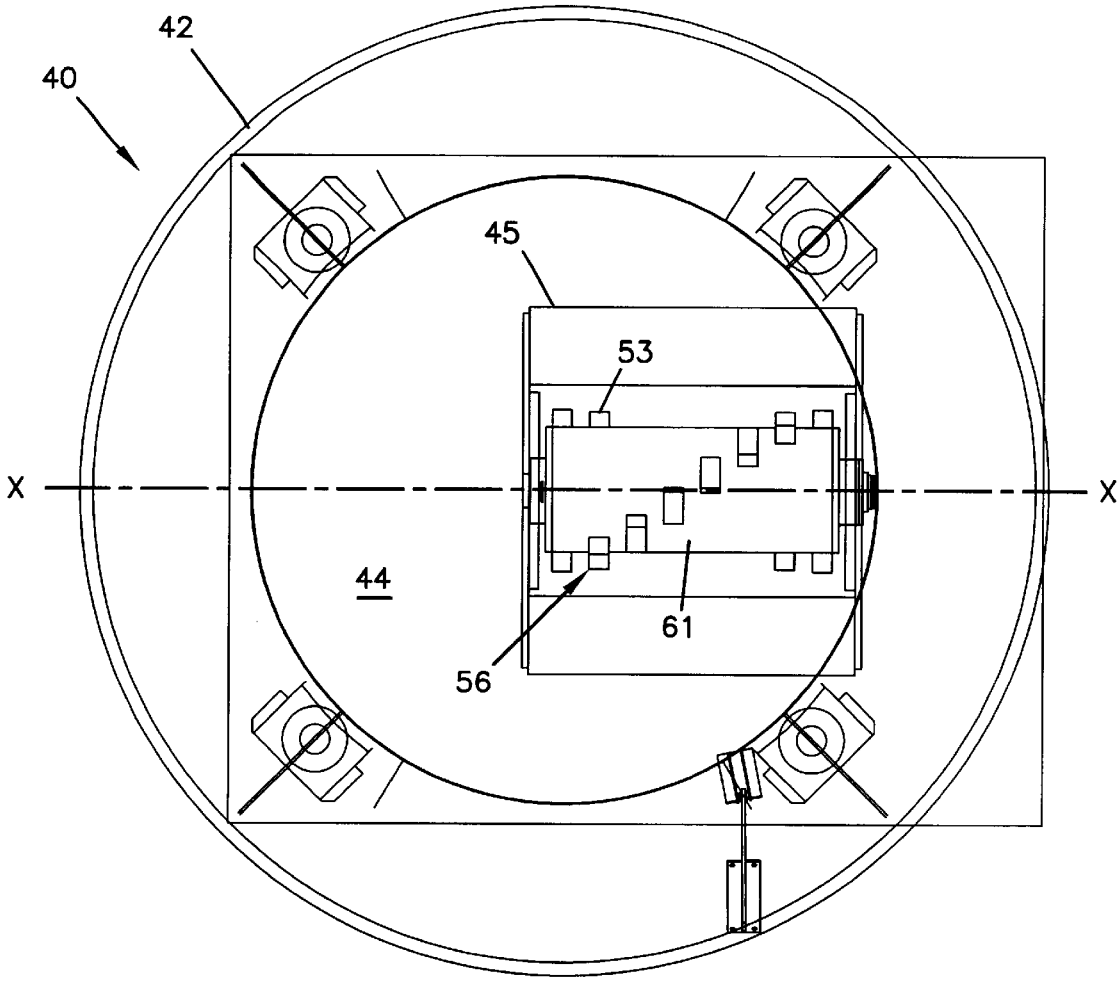
FIG. 3 is a view of the tub grinder of FIG. 2.

Referring to FIGS. 2 and 3, a tub grinder 40 is shown. The tub grinder 40 is being shown exclusively to provide an illustrative field or environment to which the various aspects of the present invention are applicable. It will be appreciated that the tub grinder 40 is but one example of a type of grinding machine to which the various aspects of the present invention can be applied, and is not intended to in any way limit the scope of the present invention.

The tub grinder of FIGS. 2 and 3 includes a rotary tub 42 mounted above a horizontal floor 44 for rotation about a vertical axis z—z. The floor 44 and the tub 42 are secured to a frame 48 of a trailer 46. The frame 48 includes a hitch 50 for attachment to a semi-tractor for towing the tub grinder 40. Wheels 52 are mounted on the frame 48. A rotary grinder member or hammermill 56 is secured to the frame 48 beneath the tub 42.

As best illustrated in FIG. 3, the floor 44 includes a floor opening 45 for allowing an upper portion of the hammermill 56 to extend into the tub 42. The hammermill 56 is mounted for rotation about a horizontal axis x—x and includes a plurality of hammers 53 (shown schematically in FIGS. 2 and 3) that engage and crush waste material deposited in the tub 42. The hammers 53 are secured to a drum 61 of the hammermill 56 as described below.

The hammermill 56 is coupled via a shaft 54 to an engine 58 for rotating the hammermill 56. In operation, the tub 42 is rotated about the vertical axis z—z by a motor 55 (shown in FIG. 2). Simultaneously, the hammermill 56 is rotated about the horizontal axis x—x.

Figure 4A:
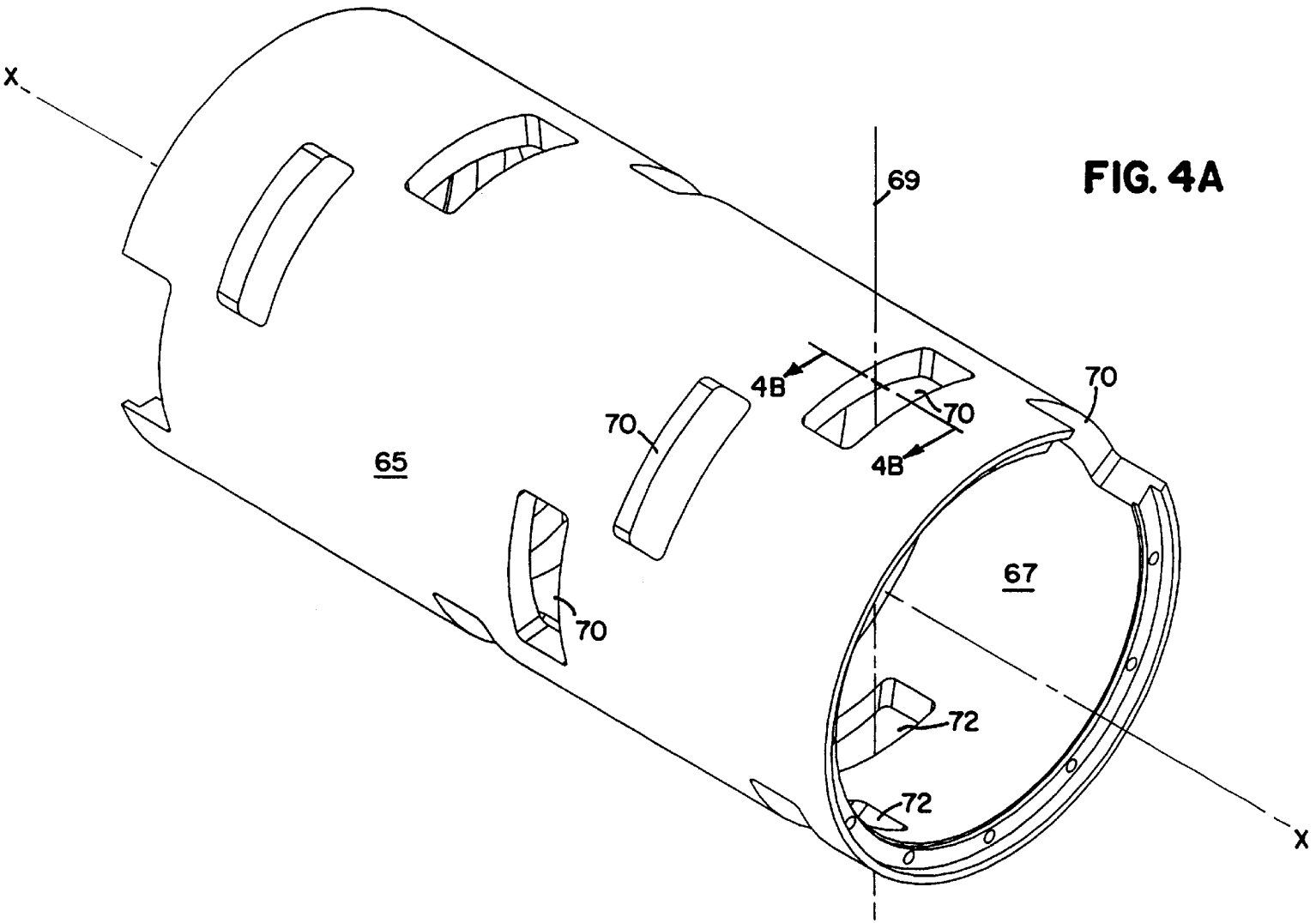
FIG. 4*a* is a perspective view of a cylindrical drum of one embodiment of the invention.
Figure 4B:
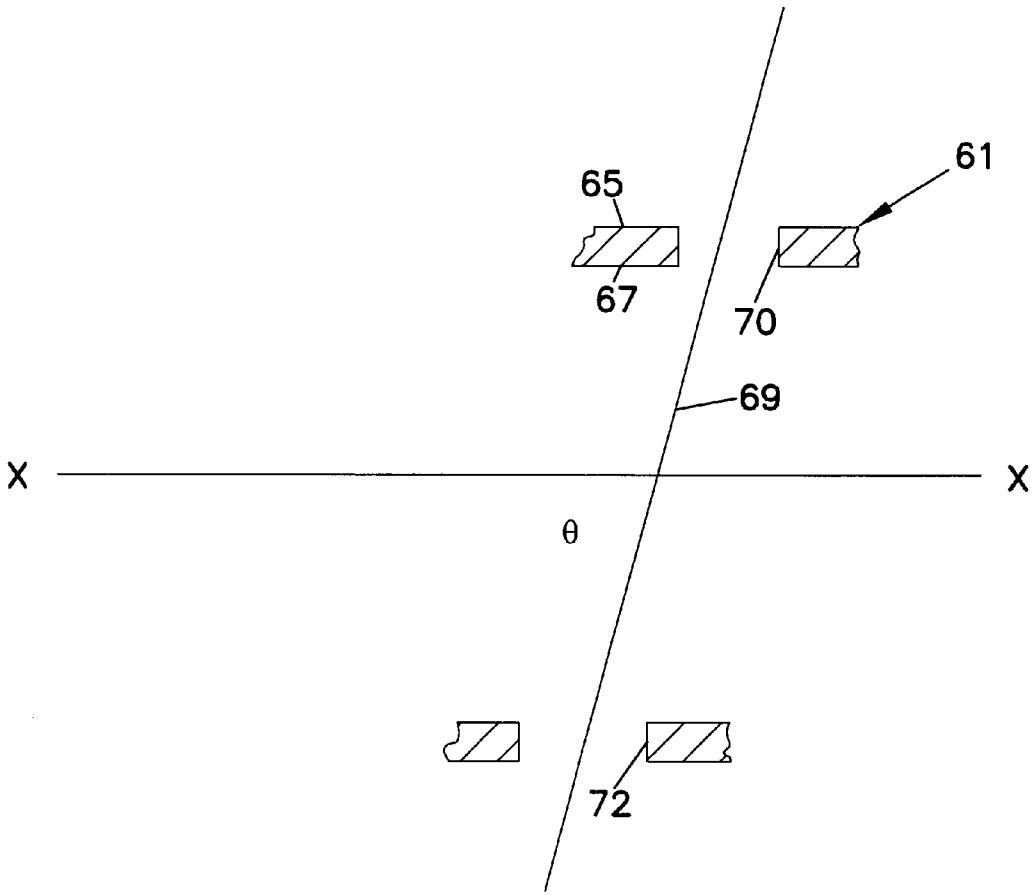
FIG. 4*b* is a cross-sectional view of the drum of FIG. 4*a* taken along section lines 4*b*–4*b;*

FIG. 4*a* shows the cylindrical drum 61 of the hammermill 56. The cylindrical drum 61 is hollow and includes a cylindrical wall having a cylindrical exterior surface 65 and a cylindrical interior surface 67. The cylindrical drum 61 defines a plurality of holes 70 arranged in a pattern that spirals around the cylindrical surface of the drum 61. Each hole 70 has a corresponding hole 72 positioned on the opposite side of the drum 61 from the hole 70. The holes 70, 72 extend through the drum 61 in a radial direction between the interior and exterior surfaces 65 and 67. Preferably, the holes 70, 72 are positioned such that straight lines 69 drawn from the holes 70 to their corresponding holes 72 pass through the horizontal axis x—x of the drum 61. In the depicted embodiments, the holes 70 are axially staggered or offset relative to their corresponding holes 72 such that the straight lines 69 extending between the holes 70, 72 intersect the horizontal axis x—x at an oblique angle θ (shown in FIG. 4*b*). In certain non-limiting embodiments, oblique angle θ is in the range of 80–90 degrees, or about 83 degrees. Preferably, the angle is selected such that cutters/grinders mounted adjacent the holes define separate cutting paths. Thus, the angle selected is typically at least partially dependent of the diameter of the drum 61. Of course, the angle θ need not be limited to oblique configurations, and could also be perpendicular.

Figure 4C:
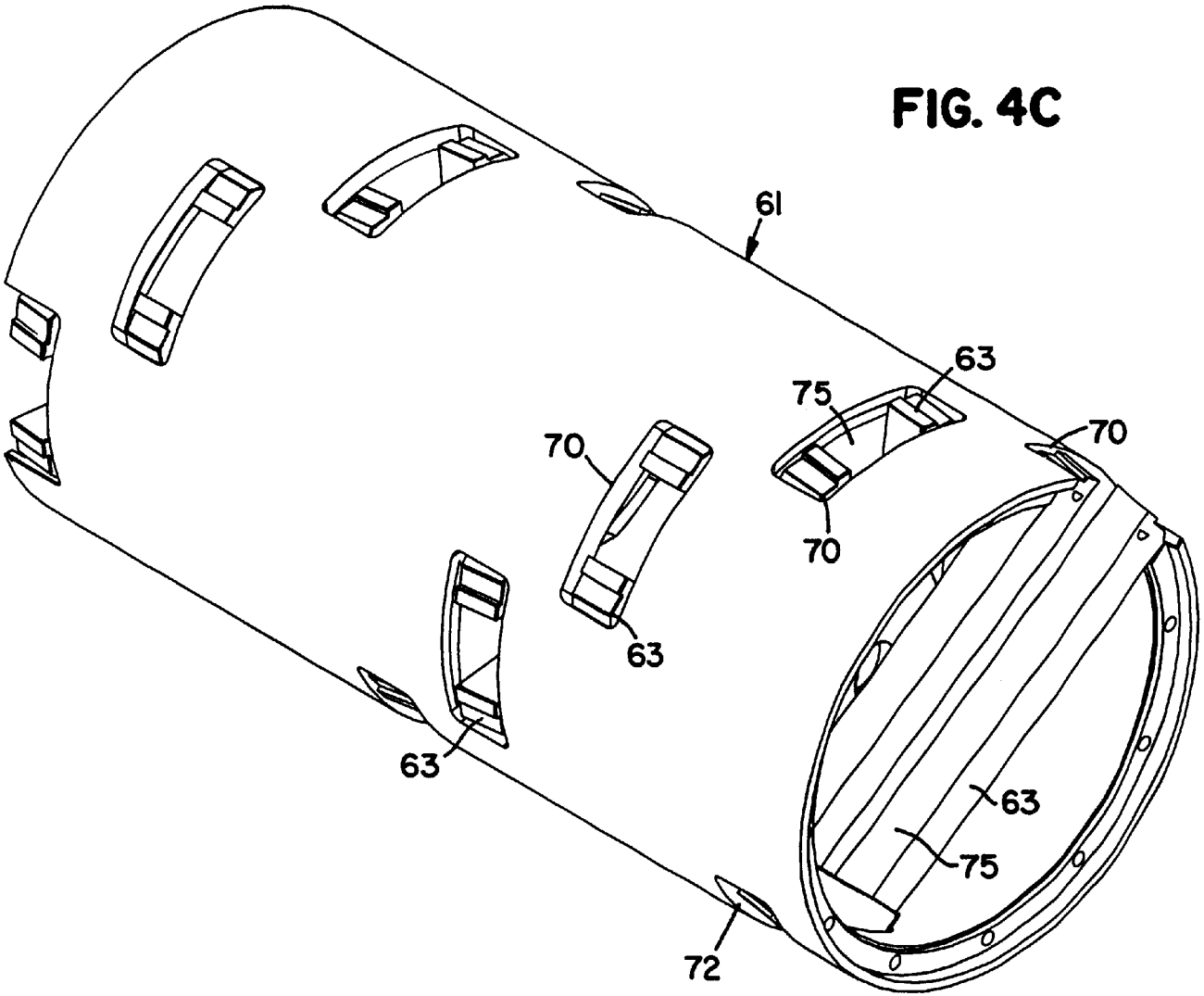
FIG. 4*c* is a perspective view of the drum of FIG. 4*a* with mounting sleeves mounted therein.

FIG. 4*c* shows the drum 61 with sleeves 63 that extend radially between the holes 70, 72. The sleeves 63 extend radially through the interior of the drum 61 and are preferably welded in place. Each sleeve 63 defines a channel 75 that extends from one of the holes 70 to a corresponding hole 72.

The shape of the holes 70, 72 in the embodiment shown in FIG. 4*a* is rectangular. However, the scope of this invention is not limited to holes 70 and 72 having a rectangular shape. For example, the holes 70 and 72 could be circles, ovals, triangles or any other shape.

Figure 5A:
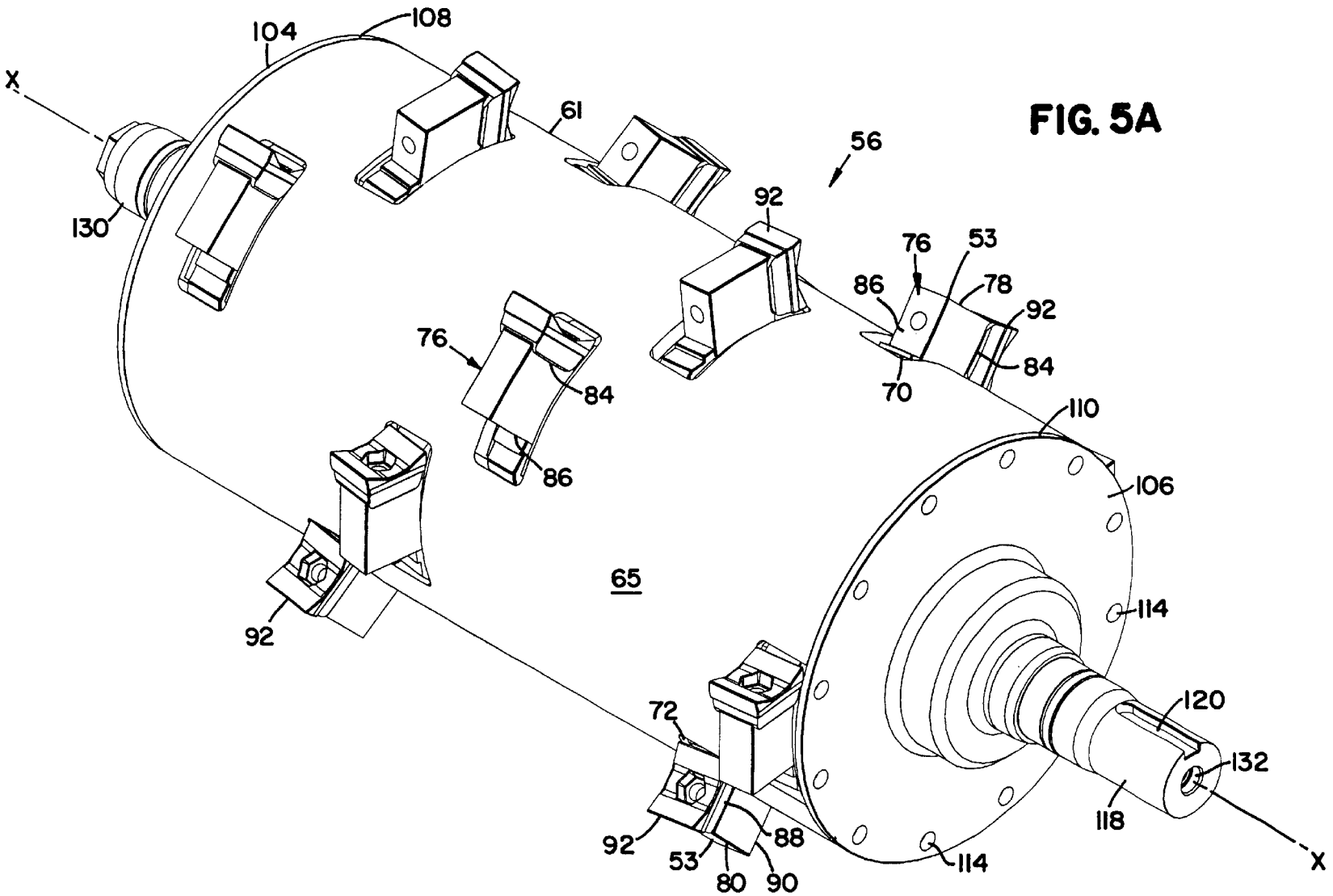
FIG. 5*a* is a perspective view of one embodiment of a hammermill of the invention.
Figure 5B:
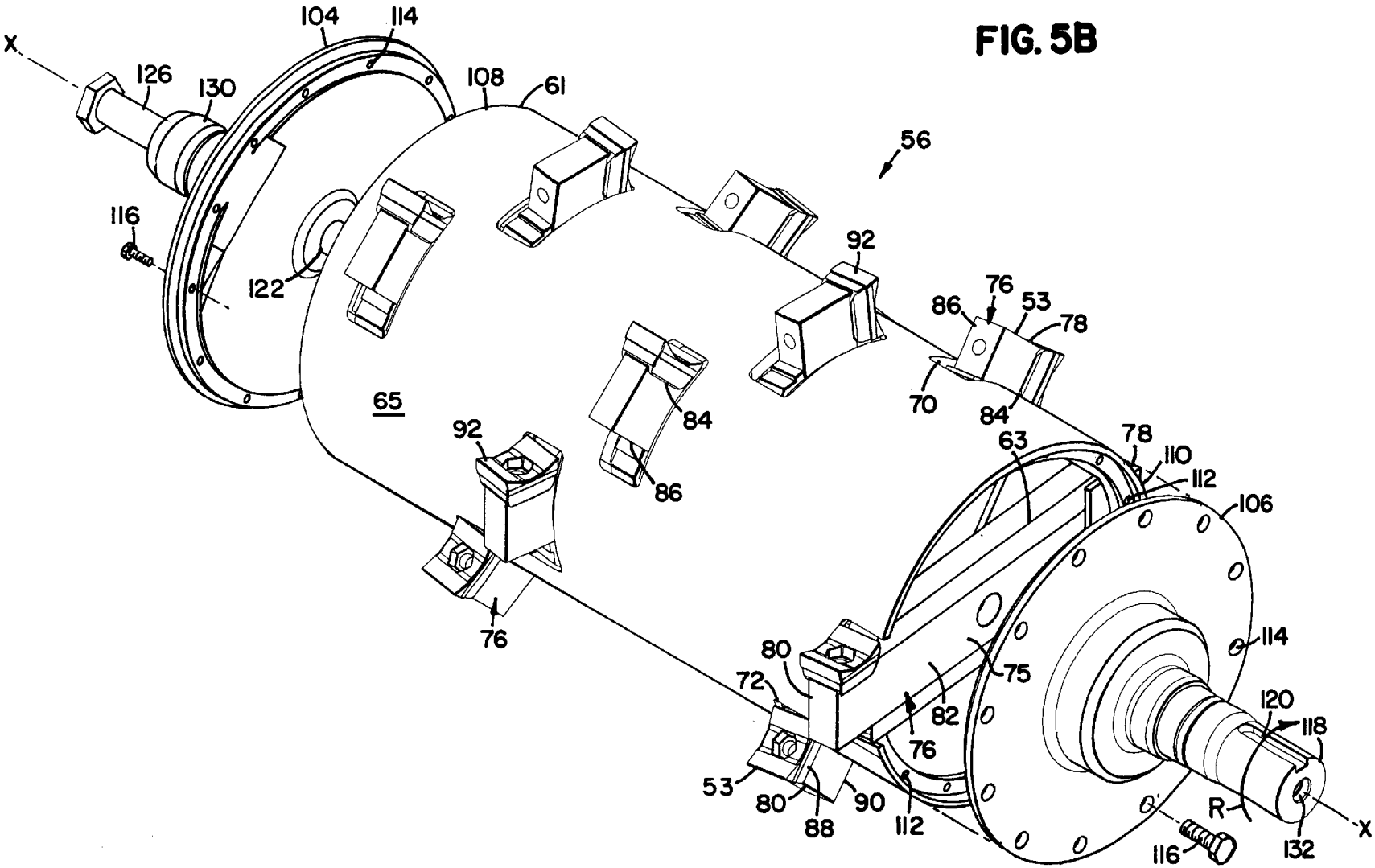
FIG. 5*b* is a partially exploded, perspective view of the hammermill of FIG. 5*a;*

FIG. 5*a* shows the hammermill 56 in isolation from the tub grinder 40. The drum 61 of the hammermill 56 includes oppositely positioned first and second ends 108 and 110 that are respectively closed or covered by first and second end caps 104 and 106. As best shown in FIG. 5*b,* the first and second ends 108,110 have threaded holes 112 that align with corresponding holes 114 in the first and second end caps 104,106. The end caps 104, 106 are preferably removably connected to the drum 61. For example, bolts 116 can be used to removably secure the end caps 104, 106 to the drum 61 by inserting the bolts through the holes 114 and then threading the bolts 116 into the openings 112. The removability of the end caps 104, 106 is advantageous because the drum 61, which has a greater tendency to wear than the end caps, can be replaced without requiring the end caps 104, 106 to be replaced at the same time. This also allows the drum 61 to be reversed (rotated end-to-end relative to the end caps 104, 106) to increase the useful life of the drum 61.

As described above, the end caps 104, 106 are connected to the drum 61 by fasteners 116. It will be appreciated that this is but one fastening technique that could be used. Other techniques include, among other things, providing mating threads on the end caps and the drum such that the end caps can be threaded onto or into the drum. Alternatively, a snap-ring configuration, as well as other configurations, could also be used to secure the end caps 104, 106 to the drum 61.

A driven shaft 118 is provided on the second end cap 106, and a non-driven shaft 130 is provided on the first end cap 104. The shafts 118, 130 are preferably connected to their respective end caps 106, 104 by conventional techniques (e.g., the shafts 118, 130 can be welded to or forged as a single piece with their respective end caps 106, 104). The shafts 118, 130 are aligned along the axis of rotation x—x of the hammermill 56 and project axially outward from their respective end caps 106, 104. The driven shaft 118 defines a keyway 120 or other type of structure (e.g., splines) for use in coupling the driven shaft 118 to the drive shaft 54 of the engine 58. In this manner, engine torque for rotating the hammermill 56 can be transferred to the hammermill 56 through the driven shaft 118. When mounted within the tub grinder 40, the shafts 118, 130 are preferably supported in conventional bearings adapted for allowing the hammermill 56 freely rotate about the axis of rotation x—x.

Referring to FIGS. 5*a* and 5*b,* the hammermill 56 also includes a plurality of through-members 76 (e.g., bars) that extend radially through the drum 61 and include ends that project radially beyond the exterior surface 65 of the drum 61. Each of the through-members 76 forms two hammers 53 positioned on opposite sides of the drum 61. Hence, the through-members 76 can be referred to as "duplex hammers." The particular embodiment shown in FIGS. 5*a* and 5*b* includes eight through-members 76 that provide a total of sixteen hammers. However, any number of through-members 76 could be used.

As best shown in FIG. 5*b,* the through-members 76 each have a first end 78, a second end 80 and a central portion 82. The central portions 82 are situated in the interior of the cylindrical drum 61. Each through-member 76 extends through one of the holes 70 of the drum 61, and also through the corresponding opposite hole 72 of the drum 61. Within the drum 61, the through-members 76 extend through the channels 75 defined by the sleeves 63. The holes 70, 72 allow the first and second ends 78, 80 to be situated outside the exterior of the cylindrical drum 61 so as to form exterior hammers. Each through-member 76 has a leading face 84 and a trailing face 86 on the first end 78, and a leading face 88 and trailing face 90 on the second end 80. The leading faces 84 and 88 and the trailing faces 86 and 90 extend radially outward beyond the exterior surface 65 of the drum 61. The leading faces 84 and 88 are the surfaces that lead the through-member 76 as it rotates in a direction designated as R in FIG. 5*b*.

Figure 5C:
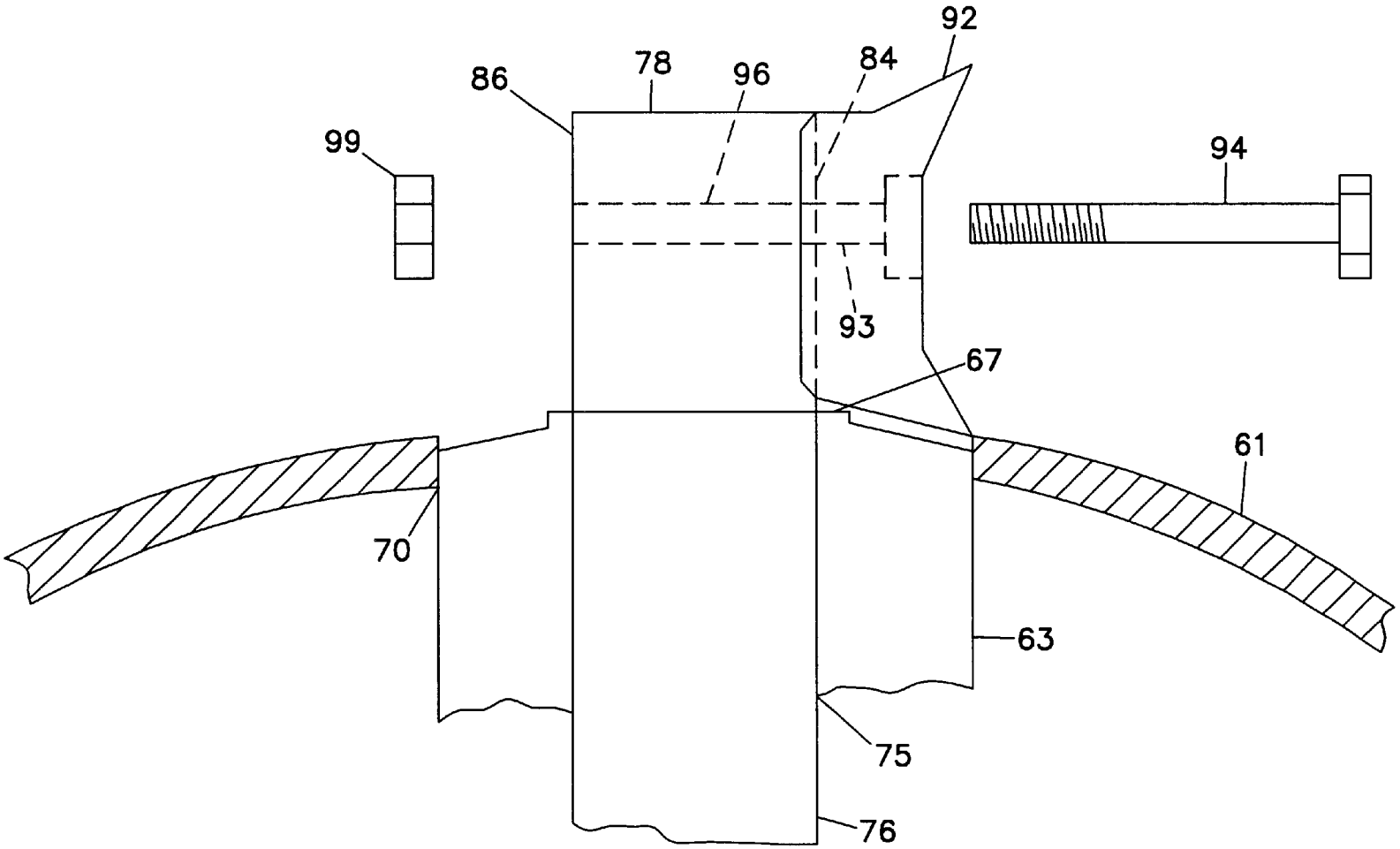
FIG. 5*c* is a side view of a connection configuration for securing a cutter to one of the hamme of the hammermill of FIGS. 5*a*–5*b;*

A cutter 92 is preferably attached to each of the leading faces 84 and 88 of the through-members 76. FIG. 5*c* shows one of the cutters 92 adapted to be attached to one of the leading faces 84. A bolt 94 is adapted to pass through co-axially aligned holes 93, 96 respectively defined by the cutter 92, and the through-member 76. By inserting the bolt 94 through the openings 93, 96 and threading a nut 99 on the bolt 94, the cutter 92 is securely clamped against the through-member 76. It will be appreciated that the cutter 92 can be any type of cutter known in the art with the preferred form of cutter being dictated by the type of grinding to be performed as is well known in the art.

When the cutter 92 is clamped to the through-member 76 as shown in FIG. 5*c,* the cutter 92 opposes or engages a retaining shoulder 67 formed at the end of the sleeve 63. In this manner, the cutter 92 fastener is protected from shear loads by transferring forces through the sleeve 63 to the drum 61. Similar cutters 92 and retaining shoulders 67 are located at each end of each through-member 78. Engagement between the cutters 92 and the shoulders 67 functions to center or align the through-members 78 such that central openings 125 of the through-members 78 align with the axis of rotation x—x of the hammermill 56. The sleeves 63 also function to guide the through-members 76 through the openings 70, 72.

The hammermill 56 also can include a rod 126 (best shown in FIG. 5*b*) that extends along the axis of rotation x—x as shown in FIG. 5*b*. The rod 126 extends through a longitudinal opening 122 defined by the non-driven shaft 130 and the first end cap 104. The rod 126 also extends through the plurality of co-axially aligned, central openings 125 defined by the through-members 76. The rod 126 also can include a threaded end that threads within an internally threaded opening 132 defined by the driven shaft 118. In this manner, the rod 126 could be used to clamp the end caps 104, 106 together. The rod 126 functions as a hammer retention system for the through-members 76 within the drum 61. A significant aspect of the invention is that a single retaining member (i.e., the rod 126) can be used to secure all of the through-members 76 to the drum 61.

In an alternative embodiment, the rod 126 can be used to retain shorter through-members (e.g., half the length of the through-members 76) that each extend through only one of the openings 70, 72. Also, the rod 126 need not be threaded into the driven shaft 118. For example, the rod 126 can be configured to thread within the longitudinal opening 122 of the non-driven shaft 130 (e.g., the rod 126 can have threads near its head). In such a configuration, the far end of the rod preferably fits within an unthreaded sleeve or opening defined by the driven shaft 118.

Figure 6:
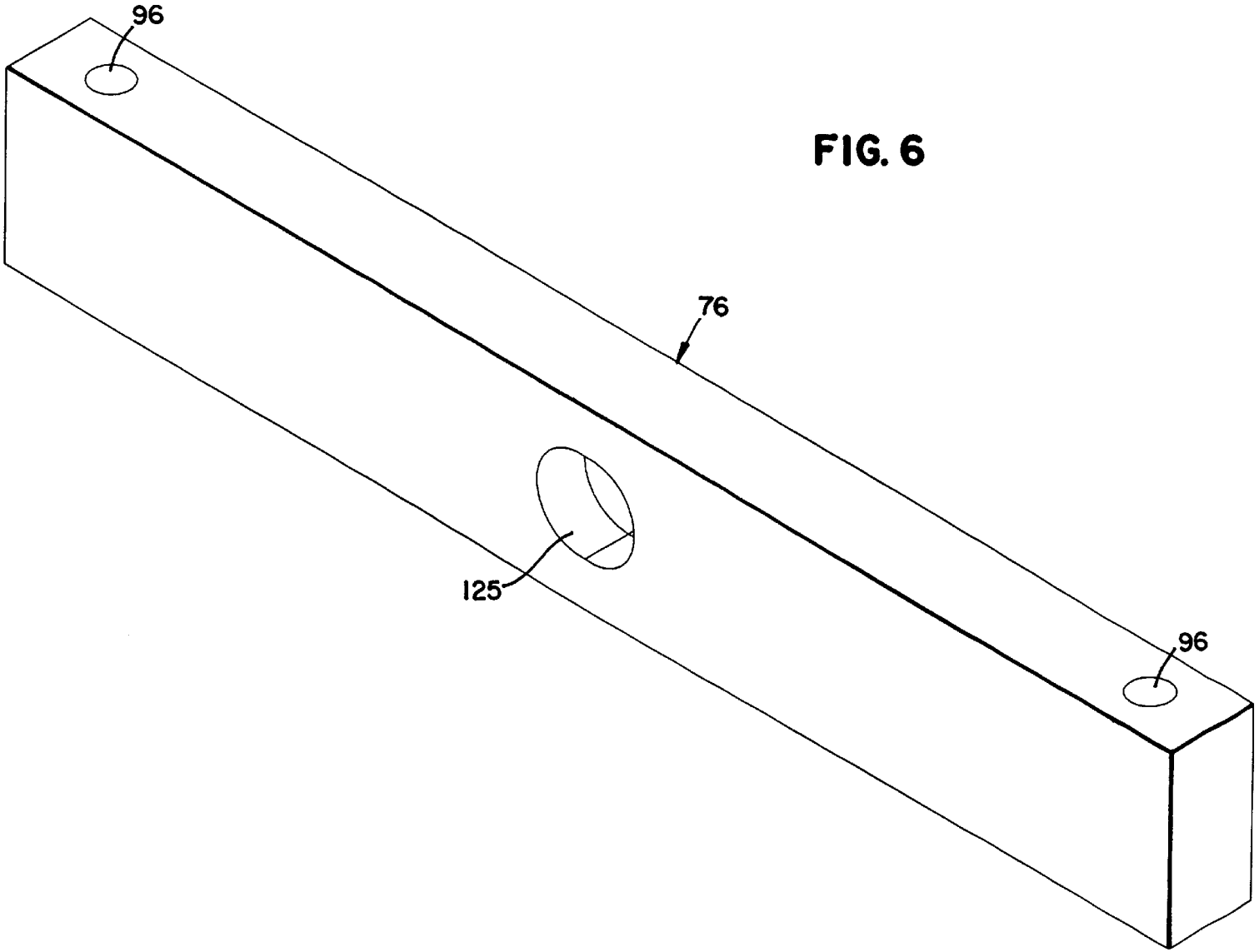
FIG. 6 is a perspective view of one of the duplex hammers of the hammermill of FIG. 5*a;*

FIGS. 6 shows one of the through-members 76 in isolation from the drum 61. As shown in FIG. 6, the through-member 76 comprises a generally rectangular bar having the opening 125 defined at a central region of the bar, and the cutter mounting holes 96 defined at the ends of the bar. Of course, other shapes (e.g., octagonal, hexagonal, round with flats, etc.) could also be used.

Figure 7A:
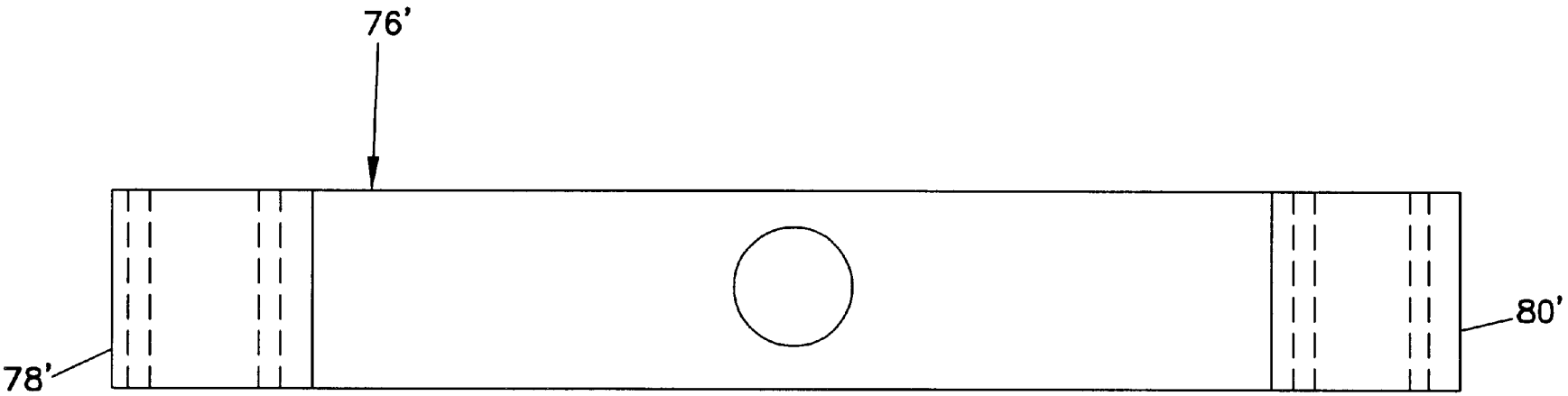
FIG. 7*a* is a side view of an alternative embodiment of a duplex hammer of the invention
Figure 7B:
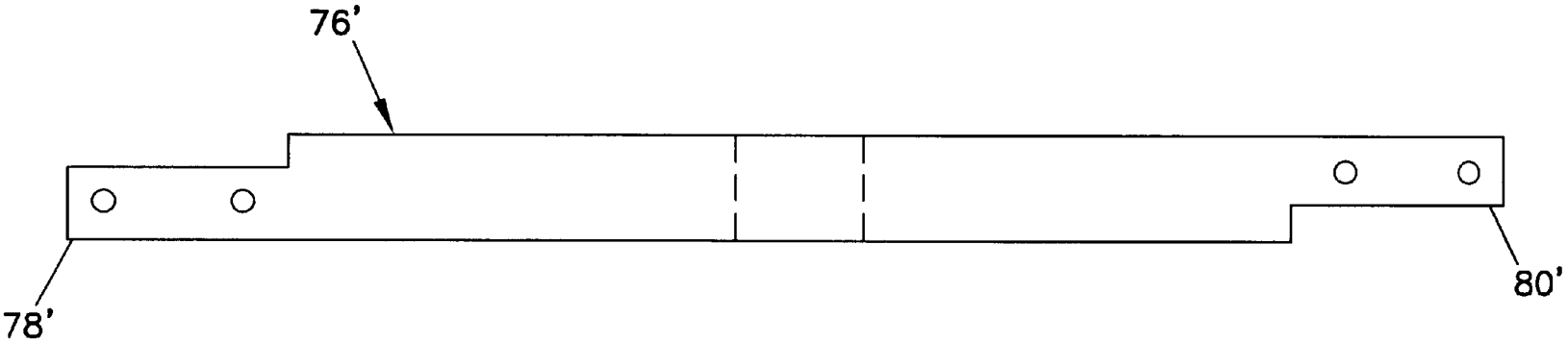
FIG. 7*b* is a side view of the alternative embodiment of the duplex hammer of FIG. 7*a* taken a a line perpendicular to the view of FIG. 7*a;*

FIGS. 7*a* and 7*b* show side views of an alternative embodiment of through-member 76' adapted to be mounted in the drum 61. The through-member 76' has first and second ends 78', 80' that are adapted for mounting narrow faced cutters used for more aggressive grinding of certain types of material.

Figure 8:
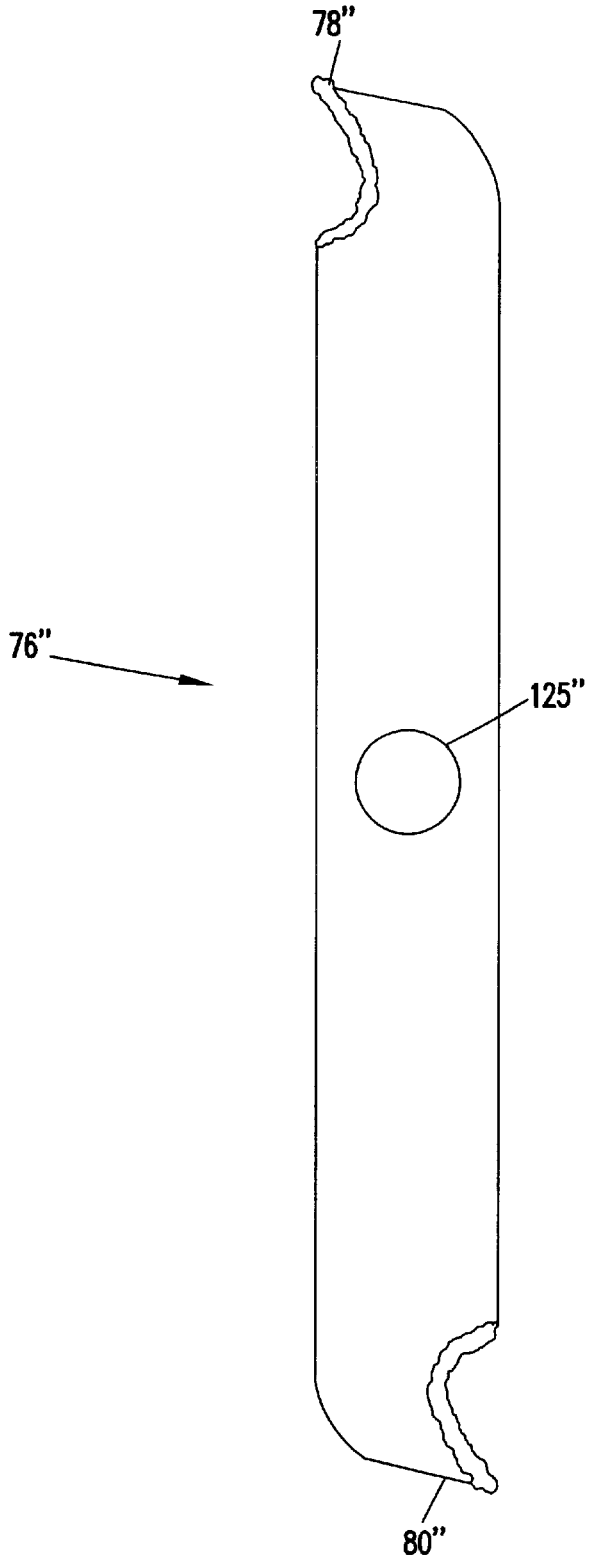

FIG. 8 shows another through-member 76" adapted for use with the hammermill 56. The through-member 76" has hooked ends 78", 80" that form aggressive cutting teeth. Shims can be used at the sides of the through-member 76" to stabilize the through-member 76" within the openings 70, 72 of the drum 61. Hardfacing can be used at the hooked ends 78", 80" to improve durability. Additionally, the through-members 76" preferably include central openings 125" for allowing the through-members 76" to be connected to the drum 61 by a single retaining member (e.g., the rod 126) in the same manner described above with respect to the through-members 76.

Figure 9:
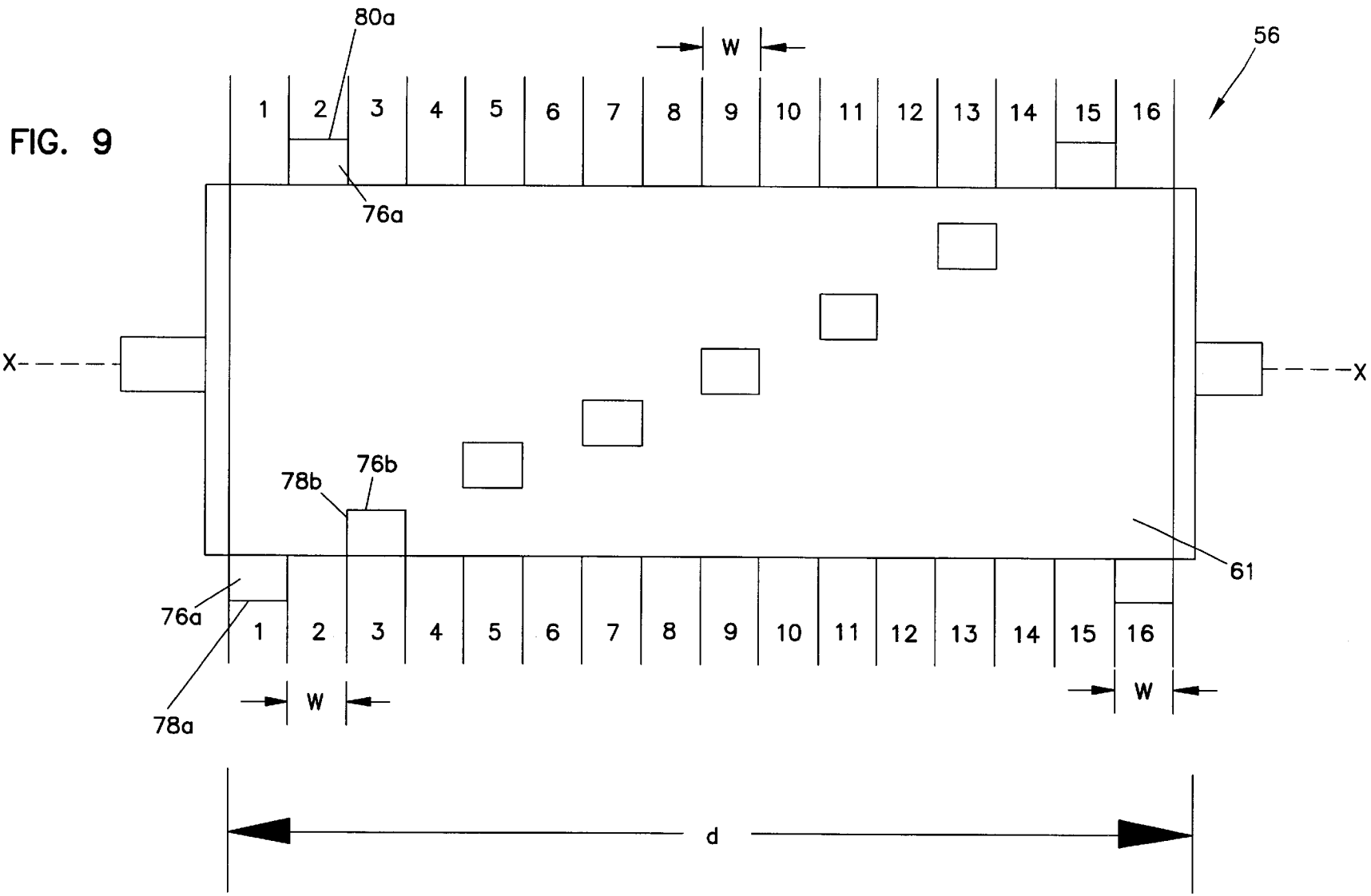
* and FIG. 9 is a schematic, elevational view of the hammermill of FIG. 5*a.*

FIGS. 5*a* and 5*b* show that the through-members 76 of the hammermill 56 are skewed relative to the axis of rotation x—x of the hammermill 56 (i.e., the through-members 76 intersect the axis x—x at an oblique angle). The angled nature of the through-members 76 relative to the axis x—x causes the first end 78 of each through-member 76 to travel along a different grinding path than the its corresponding second end 80. For example, as shown in FIG. 9, a first one of the through-members 76*a* has a first end 78*a* that travels along path 1, and a second end (80*a*) that travels along path 2. Similarly, a second one of the through-members 76*b* has a first end 78*b* that travels along path 3, and a second end (not shown) that travels along path 4. The remainder of the through-members are preferably arranged in a similar configuration. Hence, the 8 through-members provide 16 separate cutting paths spaced along the axis x—x of the drum 61.

In certain embodiments, the hammers are adapted to provide full face coverage of the drum 61. Full face coverage means that there are no substantial gaps between adjacent cutting paths. Thus, as shown in FIG. 9, path 1 terminates where path 2 begins; path 2 terminates where path 3 begins; path 3 terminates where path 4 begins; etc. The skewed configuration of the through-members 76 allows full-face coverage to be provided with a relatively small number of through-members 76. The skewed configuration also allows hammers to be mounted directly at the far edges of the drum 61. While paths 1–16 are non-overlapping, it will be appreciated that alternative embodiments can have overlapping paths. Additionally, for certain applications, gaps can be provided between adjacent cutting paths.

Still referring to FIG. 9, each of the cutting paths 1–16 is typically defined by a maximum width of a cutter corresponding to each path. For example, paths 1 and 2 have widths w (measured in an axial direction) that correspond to the maximum widths of the cutters that are swung through the paths. For certain embodiments, the sum of the widths of all the paths is equal to or greater than a length d of the drum 61. As shown in FIG. 9, the sum of the widths equal the length d. However, if the paths overlap, the sum of the widths will be larger than the length d. By contrast, if gaps are provided between adjacent paths, the sum of the widths is less than the length d.

The method of replacing parts for the rotary grinder of this invention will now be explained. These various methods include replacement of cutters, replacement of through-members, and replacement of drums. These methods are all made easier in this invention.

The cutters can be easily reversed or replaced by removing the bolt 94. The old cutter 92 is removed and a new cutter 92 or a different type cutter is fastened to the through-member 76 with bolt 94.

One of the through-members 76 can be individually replaced by removing at least one of the cutters 92 from the through-member 76 desired to be replaced. The rod 126 is then removed from the hole in the driven shaft 118 and removed from the holes 125 of the through-members 76 by sliding the rod 126 at least partially out of the drum 61. The through-member 76 to be replaced can then easily be slid out of the drum 61. A new through-member 76 is then slid into the position previously occupied by the old through-member 76. Next, the rod 126 is slid back through the holes 125 and is inserted into the hole 132 in the driven shaft 118. Lastly, cutters 92 are secured to the ends of the new through-member 76. An important advantage of the through-members 76 is that when each through-member 76 is removed, equal weights are concurrently removed from opposite sides of the drum 61. Thus, during removal of the through-members 76, there are no unbalanced forces that cause the drum 61 to inadvertently rotate. Instead, the drum 61 remains balanced at all times.

During use of the hammermill 56, the leading faces 84, 88 of the through-members 76 can become worn or deformed such that flat surfaces are no longer provided for mounting the cutters 92. If this happens to a particular through-member 76, the through-member 76 can be removed by detaching the cutter 92 from the damaged end of the through-member 76, and by sliding the through-member 76 from the drum 61. Thereafter, the through-member 76 can be reversely mounted in the drum 61 such that the previous trailing faces 86, 90 of the through-member 76 become the leading faces 84, 88. Once the through-member 76 has been re-inserted through the drum, the cutter 92 can be fastened to the new leading face 84, 88 (i.e., the face that was the trailing face before the through-member 76 was reversed).

The following steps outline the method for replacing the drum 61. The drum 61 can be replaced along with the through-members 76 and cutters 92. Alternatively, the drum 61 can be replaced alone, while keeping the old through-members 76 and cutters 92. To replace the drum 61 along with the through-members 76 and cutters 92, first remove the rod 126 as described above. Next, remove the first and second end caps 104, 106 by removing bolts 116. The old drum 61 along with its associated through-members 76 and cutters 92 can then be discarded, and the end caps 104, 106 can be mounted on a new drum 61 with new through-members 76 and cutters 92. Lastly, the rod 126 is mounted axially through the new drum.

The following method can be used when replacing the drum alone while keeping the old through-members 76 and cutters 92. First, the rod 126 and the through-members 76 are removed. In removing the through-members 76, at least one of the cutters 92 will be removed from each of the through-members 76 to allow the through-members 76 to be pulled from the drum 61. Next, the end caps 104, 106 are removed as described above. Subsequently, the old drum 61 is removed and replaced with a new drum 61. Finally, the hammermill is reassembled in reverse order to the disassembly described above.

If through-members 76" are used with the drum 61, it will be appreciated that some or all of the through-members 76" may fall from the drum 61 when the rod 126 is removed. This occurs because the through-members 76" do not have cutters for maintaining alignment with the rod 126. Thus, during disassembly of the grinder, such through-members 76" will typically be removed from the drum 61 in concert with the removal of the rod 126.

With use, contact between the through-members 76 and the trailing shoulders of the sleeves 63 can cause the shoulders to deform or "mushroom." When this occurs, the end caps 104, 106 can be removed as described above, and the drum 61 can be reversed end-to-end. Thereafter, the through-members 76 can be reversed such that the cutters 92 face in the appropriate direction. By reversing the drum 61, the useful life of the drum can be increased.

With regard to the forgoing description, it is to be understood that changes may be made in detail, especially in matters of the construction materials employed and the size, shape and arrangement of the parts without departing from the scope of the present invention. For example, while the various aspects of the present invention are particularly applicable to hammermills, such aspects are also applicable to other types of rotary grinders that use hammers such as mining equipment, brush chippers, excavation equipment, concrete cutters, etc. As used herein, the term "grind" is intended to include terms such as chop, cut, crush, pulverize, etc. It is intended that these specific and depicted aspects be considered exemplary only, with a true scope and spirit of the invention be indicated by the broad meaning of the following claims.

What is claimed is:

1. A rotary grinder comprising:

(a) a cylindrical drum rotatable about its axis, the cylindrical drum comprising a cylindrical wall and a first and second end, the cylindrical wall defining a first receiving hole and a second receiving hole, and the cylindrical wall also deforming an interior and an exterior of the cylindrical drum;

(b) a removable through-member received by the cylindrical wall at both the first and second receiving holes, the through-member comprising:

(i) a first end that extends to the exterior of the cylindrical drum by passing through the first receiving hole; and (ii) a second end opposite the first end that extends to the exterior of the cylindrical drum by passing through the second receiving hole; and (c) removable cutting structures mounted on the first and second ends for securing the through-member to the drum, the cutting structures being configured to prevent radial movement of the through-member relative to the cylindrical drum such that the through-member is prevented from being removed from the drum when both cutting structures are in place.

2. The grinder of claim 1, wherein the through-member intersects the axis of the drum.

3. The grinder of claim 2, wherein the through-member intersects the axis of the drum at an oblique angle.

4. The grinder of claim 1, further comprising a rod aligned along the axis of the drum, the rod passing through the through-member for assisting in securing the through-member to the drum.

5. The grinder of claim 4, further comprising end caps mounted on the drum, wherein the drum is reversible relative to end caps and wherein the rod is connected to at least one of the end caps.

6. The grinder of claim 1, further comprising a plurality of through-members that extend through the drum.

7. The grinder of claim 6, further comprising a rod that extends along the axis of the drum and through the through-members to retain the through-members within the drum.

8. The grinder of claim 1, wherein the through-member comprises a rectangular bar.

9. The grinder of claim 1, wherein the cutting structures comprise cutters fastened to the ends of the through-member by one or more removable fasteners.

10. The grinder of claim 9, wherein the removable fasteners are bolts.

11. The grinder of claim 1, wherein the through-member is reversible relative to the drum.

12. The rotary grinder of claim 1, further comprising a guide for receiving the through-member, the guide extending radially within the drum between the first and second receiving holes.

13. The rotary grinder of claim 12, wherein the guide is fixedly connected to the drum.

14. The rotary grinder of claim 13, wherein ends of the guide are welded to the drum adjacent the first and second receiving holes.

15. The rotary grinder of claim 12, wherein the guide includes radial shoulders that project outwardly from the first and second receiving holes and engage the cutting structures.

16. A rotary grinder comprising:

a cylindrical hollow drum having an exterior surface and an interior surface, the drum being rotatable about a longitudinal axis of the drum and the drum defining a plurality of openings that extend through the drum between the interior and exterior surfaces;

a plurality of through-members that pass through the cylindrical drum, each through-member including a first end positioned opposite from a second end;

grinding portions positioned at the first and second ends of each through-member, the grinding portions being configured to extend radially beyond the exterior surface of the cylindrical drum through the openings in the drum; and guides for slidably receiving the through-members, the guides extending radially within the drum between the openings of the drum, the guides being fixedly connected with the drum and being configured to guide the through-members through the drum during assembly.

17. The grinder of claim 16, wherein the first and second grinding portions comprise aggressive teeth.

18. The grinder of claim 16, wherein the grinding portions comprise hammers.

19. The grinder of claim 18, further comprising cutters mounted on the hammers.

20. The grinder of claim 16, wherein the through-members intersect the longitudinal axis of the cylindrical drum.

21. The grinder of claim 20, wherein the through-members intersect the longitudinal axis at an oblique angle.

22. The grinder of claim 20, wherein the first and second ends of the through-members are positioned on opposite sides of the drum.

23. The grinder of claim 20, further comprising a retaining member that extends along the longitudinal axis and secures all of the through-members to the drum.

24. The grinder of claim 23, wherein the retaining member extends through the through-members.

25. The rotary grinder of claim 16, wherein the guides are metal.

26. The rotary grinder of claim 16, wherein the guides are welded within the drum.

27. A rotary grinder comprising:

a hollow, cylindrical drum having an interior surface and an exterior surface, the drum being rotatable about a longitudinal axis of the drum, and the drum defining a plurality of openings that extend through the drum between the interior and exterior surfaces;

a plurality of grinding members, each grinding member having a first end that extends through one of the openings defined by the drum and a second end that extends through another of the openings defined by the drum; and a retaining member that extends longitudinally through the drum for securing the grinding members to the drum, the retaining member being removable from the grinding members to allow the grinding members to be removed from the drum.

28. The grinder of claim 27, wherein the retaining member is aligned along the longitudinal axis of the drum.

29. The grinder of claim 28, wherein the retaining member passes through apertures defined by the grinding members.

30. The grinder of claim 27, wherein the drum has axial ends enclosed by end caps, and the end caps support the retaining member.

31. The grinder of claim 27, wherein the retaining member is a single member that secures all of the grinding members to the drum.

32. A rotary grinder comprising:

a plurality of grinding members rotatable about an axis of rotation, each of the grinding members intersecting the axis of rotation at an oblique angle and including first and second ends on opposite sides of the axis of rotation, the first and second ends of each grinding member being positioned to define separate cutting paths as the grinding members are rotated about the axis of rotation; and a hollow drum aligned along the axis of rotation, the drum defining pairs of first and second openings, the grinding members passing radially through the drum and including first ends that extend through the first openings and second ends that extend through the second openings; and a retaining member that extends longitudinally through the drum and extends through co-axially aligned openings defined by the grinding members.

33. The rotary grinder of claim 32, wherein the drum has axial ends, and the grinding members define cutting paths located directly at the axial ends.

34. The rotary grinder of claim 32, wherein the grinding members provide full-face coverage of the drum.

35. The rotary grinder of claim 32, wherein the separate grinding paths defined by the grinding members when rotated about the axis of rotation do not overlap.

* * * * *